United States Patent [19]

Grimes et al.

[11] 3,997,369

[45] Dec. 14, 1976

[54] PRODUCTION OF METALLIC ARTICLES

[75] Inventors: Roger Grimes, Amersham; Kenneth John Gardner, Chalfont St. Peter; Michael James Stowell, Saffron Walden; Brian Michael Watts, Haverhill, all of England

[73] Assignees: The British Aluminium Company Limited, London; T. I. (Group Services) Limited, Birmingham, both of England

[22] Filed: May 12, 1975

[21] Appl. No.: 576,317

[30] Foreign Application Priority Data

May 13, 1974 United Kingdom ..... 21061/74

[52] U.S. Cl. ..... 148/11.5 R; 148/11.5 A; 148/11.5 C

[51] Int. Cl.[2] ..... C22F 1/00; C22F 1/04; C22F 1/08

[58] Field of Search ..... 148/11.5 R, 11.5 A, 148/11.5 C

[56] References Cited

UNITED STATES PATENTS

| | | | |
|---|---|---|---|
| 3,529,457 | 9/1970 | Butler et al. | 148/11.5 R |
| 3,567,524 | 3/1971 | Cook et al. | 148/11.5 R |
| 3,578,511 | 5/1971 | Mehl et al. | 148/11.5 R |
| 3,595,060 | 7/1971 | Hundy | 148/11.5 R |
| 3,653,980 | 4/1972 | Eichelman, Jr. | 148/11.5 C |

*Primary Examiner*—W. Stallard
*Attorney, Agent, or Firm*—Karl W. Flocks

[57] ABSTRACT

Alloys having a composition suitable for superplastic deformation usually require heat treatment after casting and mechanical working in order to produce in the alloy the necessary fineness of grain stucture to permit such deformation to occur. It has now been found that some such alloys including in particular ranges of aluminum alloys containing zirconium (or Nb, Ta or Ni) may be heated to a superplastic forming temperature and non-superplastically deformed at that temperature to induce dynamic recrystallisation and simultaneously produce a fine recrystallised grain structure and superplastic deformation.

18 Claims, No Drawings

PRODUCTION OF METALLIC ARTICLES

BACKGROUND OF THE INVENTION

This invention relates to the production of metallic articles.

It is known that within limited temperature ranges and at limited strain rates certain alloys may be processed to give a very fine grain structure and thereafter be capable of deforming superplastically. Providing that the processed structure is sufficiently fine these alloys then exhibit abnormally high plasticity under relatively low loads when compared with the same alloys that do not possess extremely fine grain sizes. It is also known that the phenomenon of superplastic deformation may be employed to enable the relatively cheap manufacture of articles from metal blanks which have been processed to have extremely fine grain sizes.

SUMMARY OF THE INVENTION

It is an object of this invention to provide a means of forming metallic articles from certain metallic blanks which have not been processed to possess extremely fine grain sizes.

According to one aspect of the present invention there is provided a method of producing simultaneously a fine recrystallised grain structure in a metallic alloy having a composition suitable for superplastic deformation but having a grain structure which precludes such deformation and of forming an article from said alloy by superplastic deformation comprising raising a blank of the alloy to a forming temperature, applying a force to the blank at said temperature to deform the blank non-superplastically and induce dynamic strain recrystallisation and continuing the application of said force so that said fine recrystallised grain structure is progressively developed and the partly formed blank is superplastically deformed to form the article.

So far as predominantly aluminium alloys are concerned, as exemplified for example by those disclosed in our earlier applications Nos: 33922/71 and 2846/73, it had been believed that the basic alloy as cast and subsequently mechanically worked would need additional heat treatment to form a sufficiently fine grain structure to achieve superplasticity. However, it has now been found that metallic blanks rolled from suitable aluminium alloys may be formed into components without the necessity for a blank conditioning stage.

In this specification all percentages are by weight.

According therefore to another aspect of the present invention there is provided a method of producing simultaneously a fine recrystallised grain structure in an aluminium alloy and of forming an article from said alloy by superplastic deformation comprising raising a blank of the alloy to a forming temperature, applying a force to the blank at said temperature to deform the blank non-superplastically and induce dynamic strain recrystallisation and continuing the application of said force so that said fine recrystallised grain structure is progressively developed and the partly formed blank is superplastically deformed to form the article, said alloy being predominantly aluminium of a substantially single phase solid solution and which includes one or more elements selected from one or more of the following Cu, Zn, Mg, Mn, Si, Li and Fe to encourage recrystallisation and at least one of the elements Zr, Nb, Ta and Ni in an amount of at least 0.25% substantially all of which is present in solid solution to inhibit grain coarsening, the total amount of the latter elements not exceeding 1%. The forming temperature is preferably in the range 380° C to 580° C.

DESCRIPTION OF THE PREFERRED EMBODIMENTS

It has previously been believed that, because the stacking fault energy of aluminium is high, it would not be possible to obtain dynamic recrystallisation (i.e. recrystallisation simultaneously with hot deformation) in aluminium and its alloys. We have found that the addition of elements, such as copper or zinc or zinc and magnesium does enable dynamic recrystallisation to occur. Additionally by casting the alloy in such a way that the cast ingot is supersaturated with not less than 0.25%Zr (or Nb, Ni or Ta) substantially the whole of which is in solid solution it is possible to produce during subsequent processing a dispersion of very fine particles of $ZrAl_3$ which restrict the growth of newly formed grains. When a heavily cold worked sheet of an Al-10%Zn-0.5%Zr alloy is raised to the superplastic deformation temperature and held at that temperature without deformation it will eventually recrystallise to a coarse non-uniform grain size. However, if an identical alloy sheet is raised to the same temperature and subjected to a mechanical force to deform the sheet non-superplastically a fine recrystallised grain structure will progressively develop over about the first 200% strain so that superplastic deformation then occurs. During the commercial manufacture of, for example, the alloys described in our copending British patent applications 33922/71 and 2846/73 the semi-finished product would generally be rolled sheet the structure of which consists of heavily cold worked matrix containing a dispersion of very fine particles of $ZrAl_3$ derived from the zirconium supersaturation of the cast ingot during subsequent processing. Some other precipitates may also be present. We have discovered that when the sheet is heated to the superplastic forming temperature some recovery and recrystallisation occurs but it is only during the application of a mechanical strain that dynamic recrystallisation to a fine grain size takes place and this enables superplastic deformation to occur.

In our copending applications No: 33922/71 and 2846/73 we have disclosed particularly suitable alloys which in their broadest forms are:

1. A superplastically deformable aluminium-base alloy consisting of an aluminium-base alloy selected from non-heat treatable aluminium-base alloys containing at least 5% Mg or at least 1% Zn and heat-treatable aluminium-base alloys containing one or more of the elements Cu, Mg, Zn, Si, Li and Mn in known combinations and quantities, and at least one of the elements Zr, Nb, Ta and Ni in a total amount of at least 0.30% substantially all of which is present in solid solution, said total amount not exceeding 0.80%, the remainder being normal impurities and incidental elements known to be incorporated in the said aluminium-base alloys.

2. A superplastically deformable aluminium base alloy consisting of a non-heat treatable base material selected from the group consisting of:

1. Aluminium of normal commercial purity;
2. Aluminium of 0.75 to 2.5% manganese;
3. Aluminium and 0.25 to 0.75% manganese; and
4. Aluminium and 1 to 4% magnesium; together with dynamic recrystallisation and modifying additives for these materials to achieve fine structure respectively consisting of:

1. 0.4% to 2% iron and 0.4% to 2% silicon;
2. 0.4% to 1% iron;
3. nil;
4. 0.25% to 0.75% manganese; and at least one of the elements Zr, Nb, Ta and Ni in an amount of at least 0.3% substantially all of which is present in solid solution, the total amount of said elements not exceeding 1% and the remainder being normal impurities and known incidental elements.

3. We have also found that it is possible to obtain good results with alloys containing only 0.25%Zr, provided the zirconium is virtually all in solid solution in the cast block, as may be ensured by cooling the liquid metal quickly from the alloying temperature to the freezing point and solidifying it rapidly.

The invention also extends to articles produced by the above methods.

Preferably for aluminium-copper-zirconium alloys and for aluminium-copper-magnesium-zirconium alloys the temperature range should be 430° C–500° C. For alloys of aluminium with zinc magnesium and zirconium the forming temperature should be in the range 470° C–580° C whereas for alloys of aluminium, zinc, magnesium, copper and zirconium the preferred forming temperature range is 430° C–500° C. The elements Nb, Ta or Ni may be added in place of Zr in the above alloys.

When the rate of forming is too fast dynamic recrystallisation does not occur and the blank will fail after relatively low strains. Thus when an Al-10%Zn-0.5%Zr alloy was deformed at a strain rate of $3.4 \times 10^{-2}sec^{-1}$ at 580° C an elongation of only 160% was obtained and the structure was largely unrecrystallised. The same alloy recrystallised simultaneously with deformation gave an elongation of 690% at 580° C when deformed at a strain rate of $4.2 \times 10^{-3}sec^{-1}$.

Alternatively at very low strain rates greater deformation is possible without failure but the forming method may then be too slow to be feasible commercially. Preferably the strain rate is not greater than $5 \times 10^{-2}sec^{-1}$ and with advantage not greater than $5 \times 10^{-3}sec^{-1}$. The table illustrates the influence of strain rate on ductility for an Al-6%Cu–0.5%Zr alloy. The ductility results are from uniaxial tensile tests performed with a constant cross head velocity at a temperature of 450° C.

| Cross head velocity | Corresponding initial strain rate | Elongation |
|---|---|---|
| 0.1 in/min. | $3.4 \times 10^{-3}sec^{-1}$ | 985% |
| 0.2 in/min. | $6.7 \times 10^{-3}sec^{-1}$ | 635% |
| 0.5 in/min. | $1.7 \times 10^{-2}sec^{-1}$ | 413% |
| 1.0 in/min. | $3.4 \times 10^{-2}sec^{-1}$ | 273% |

When the strain rate remains constant but the forming temperature is increased the elongation in a tensile test (which is equivalent to forming capacity in a component manufacturing operation) increases to a maximum value and then decreases from that value. At the lower temperatures complete dynamic recrystallisation does not occur, while at the optimum temperature the specimens recrystallise dynamically to a fine grain size. At temperatures above the optimum temperature elongation decreases again because some grain coarsening occurs at the higher temperature. This effect is illustrated for the Al-6%Cu-0.5%Zr alloy in the following table.

| Deformation Temperature (° C) | Elongation (%) at constant cross head velocity of 0.1 in/min. |
|---|---|
| 440 | 300 |
| 460 | 1100 |
| 480 | 1070 |
| 500 | 650 |

Increasing the rate of deformation will increase the stress necessary to cause deformation so that greater pressures will be necessary to form a component more rapidly. Alternatively, the temperature of deformation may be increased in order to reduce forming times or pressure when forming shallow components but the ductility may then be reduced. Thus shallow articles may be formed from the Al-6%Cu-0.5%Zr alloy at about 500° C while deeper articles may be formed at lower temperatures of the order of 450° C–480° C. Forming pressures for sheet 0.60 in. thick would generally be less than 60 p.s.i. although to reproduce fine detail in a reasonable time the pressure may be increased up to 120 p.s.i. The following table illustrates the increase in flow stress accompanying increase in strain rate for the Al-6%Cu-0.5%Zr alloy at temperatures of 460° C and 500° C.

| Test Temp (° C) | Initial strain rate E (per sec.) | Strain rate sensitivity m | Flow stress $\sigma$MN/meters$^2$ |
|---|---|---|---|
| 460 | $5 \times 10^{-4}$ | 0.36 | 5.20 |
| | $1 \times 10^{-3}$ | 0.42 | 7.40 |
| | $2 \times 10^{-3}$ | 0.45 | 11.00 |
| | $5 \times 10^{-3}$ | 0.40 | 18.00 |
| | $1 \times 10^{-2}$ | 0.32 | 25.00 |
| 500 | $5 \times 10^{-4}$ | 0.44 | 3.30 |
| | $1 \times 10^{-3}$ | 0.49 | 5.00 |
| | $2 \times 10^{-3}$ | 0.50 | 8.20 |
| | $5 \times 10^{-3}$ | 0.42 | 14.00 |
| | $1 \times 10^{-2}$ | 0.33 | 20.00 |

The initial grain size in the starting blank may be as coarse as 300 $\mu$ although this size varies according to the production history of the blank. During deformation this grain structure is transformed by dynamic recrystallisation and will generally be less than about 15 $\mu$ when recrystallisation is completed. In the Al-6%Cu–0.5%Zr alloy the crystallised grain size may be less than 5 $\mu$.

This invention would apply to the forming of an article by causing the blank to flow into a female mould by the application of pressure or equally to the production of an article by the application of pressure to make the blank form over a male mould.

In one example a cup-like article having a diameter of 5½ inches, and a depth of 2½ inches, was formed from Al-6%Cu–0.5%Zr sheet of starting thickness 0.98 mms. The article had a final thickness of about 0.33 mms and was formed from a circular blank of 10 inches diameter by blowing into a female mould with a pressure of 20 p.s.i. The average start rate was about $2 \times 10^{-3}sec^{-1}$ with a starting grain size in the blank of 350 $\mu$ and a final grain size in the article of about 3 $\mu$.

The total moulding time was approximately four minutes.

It will be understood that depending upon the thickness and composition of the alloy sheet and the size and shape of the article to be moulded, the moulding time will vary considerably. It may, for example, be as low as 30 seconds up to 10 minutes.

With aluminium alloys containing less than 0.30%Zr it is desirable that in the original casting operation the liquid metal should be cooled quickly from the alloying temperature employed to the freezing point of the alloy to achieve rapid solidification. For example, with an aluminium alloy containing 0.26%Zr, 0.03%Fe < 0.01%Si and 6.0%Cu, a total residence time in the liquid metal sump during the casting operation of about 0.7 minutes provides an alloy capable of superplastic elongation of 930%. This residence time of less than 1 minute compares with a time of about 2 minutes for the alloys previously discussed.

Although predominantly aluminium alloys have been discussed above, it is also believed that superplastic properties may be exhibited by alloys which are predominantly of copper, nickel, zinc and magnesium with generally similar alloying constituents.

While this description has mainly considered the formation of articles from a semi-finished sheet product the invention would also apply to the manufacture of an article by a slow forging operation starting from a rolled or extruded bar or even cast metal.

We claim:

1. A method of producing simultaneously a fine recrystallised grain structure in a metallic alloy having a composition suitable for superplastic deformation but having a grain structure which precludes such deformation and of forming an article from said alloy by superplastic deformation comprising raising a blank of the alloy to a forming temperature, applying a force to the blank at said temperature to deform the blank non-superplastically and induce dynamic strain recrystallisation and continuing the application of said force so that said fine recrystallised grain structure is progressively developed and the partly formed blank is superplastically deformed to form the article.

2. A method of producing simultaneously a fine recrystallised grain structure in an aluminium alloy and of forming an article from said alloy by superplastic deformation comprising raising a blank of the alloy to a forming temperature, applying a force to the blank at said temperature to deform the blank non-superplastically and induce dynamic strain recrystallisation and continuing the application of said force so that said fine recrystallised grain structure is progressively developed and the partly formed blank is superplastically deformed to form the article, said alloy being predominantly aluminium of a substantially single phase solid solution and which includes one or more elements selected from one or more of the following Cu, Zn, Mg, Mn, Si, Li and Fe to encourage recrystallisation and at least one of the elements Zr, Nb, Ta and Ni in an amount of at least 0.25% substantially all of which is present in solid solution to inhibit grain coarsening, the total amount of the latter elements not exceeding 1%.

3. A method according to claim 2 in which the forming temperature is in the range 380° C to 580° C.

4. A method according to claim 2 in which the blank is of an aluminium-base alloy selected from non-heat treatable aluminium-base alloys containing at least 5% Mg or at least 1% Zn and heat-treatable aluminium-base alloys containing one or more of the elements Cu, Mg, Zn, Si, Li and Mn in known combinations and quantities, and at least one of the elements Zr, Nb, Ta and Ni in a total amount of at least 0.30% substantially all of which is present in solid solution said total amount not exceeding 0.80% the remainder being normal impurities and incidental elements known to be incorporated in the said aluminium-base alloy.

5. A method according to claim 2 in which the blank is of a non-heat treatable base material selected from the group consisting of:

a. Aluminium of normal commercial purity;
b. Aluminium of 0.75 to 2.5% manganese;
c. Aluminium and 0.25 to 0.75% manganese; and
d. Aluminium and 1 to 4% magnesium; together with dynamic recrytallisation modifying additives for these materials to achieve fine structure respectively consisting of:

1. 0.4% to 2% iron and 0.4% to 2% silicon;
2. 0.4% to 1% iron;
3. nil;
4. 0.25% to 0.75% manganese;

and at least one of the elements Zr, Nb, Ta and Ni in an amount of at least 0.3% substantially all of which is present in solid solution, the total amount of said elements not exceeding 1% and the remainder being normal impurities and known incidental elements.

6. A method according to claim 2 in which the blank contains less than 0.30%Zr and in which the casting from which the blank is formed has been cooled quickly from the alloying temperature to freezing point and solidified rapidly.

7. A method according to claim 6 in which the cooling time is less than one minute.

8. A method according to claim 7 in which the cooling time is no greater than 0.7 minutes.

9. A method according to claim 2 in which for blanks of alloys of aluminium, copper and one of the elements selected from Zr, Nb, Ta or Ni and for such alloys additionally including magnesium the forming temperature range is 430° C to 500° C.

10. A method according to claim 2 in which for blanks of alloys of aluminium, zinc, magnesium and one of the elements selected from Zr, Nb, Ta or Ni the forming temperature range is 472° C and 580° C.

11. A method according to claim 2 in which for blanks of alloys of aluminium, zinc, magnesium, copper and one of the elements selected from Zr, Nb, Ta or Ni the forming temperature range is 430° C to 500° C.

12. A method according to claim 2 in which the initial strain rate of deformation is between $5 \times 10^{-2}$ $sec^{-1}$ and $5 \times 10^{-4} sec^{-1}$.

13. A method according to claim 12 in which the initial strain rate is not greater than $5 \times 10^{-2} sec^{-1}$.

14. A method according to claim 12 in which the initial strain rate is not greater than $5 \times 10^{-3} sec^{-1}$.

15. A method according to claim 2 in which the grain size of the formed article is less than 15 $\mu$.

16. A method according to claim 15 in which the grain size of the formed article is less than 5 $\mu$.

17. A method according to claim 15 in which the grain size of the blank is at least 300 $\mu$.

18. A method according to claim 2 in which the pressure applied to the blank is within the range 20 p.s.i. to 120 p.s.i.

* * * * *